US008677771B2

(12) United States Patent
Li et al.

(10) Patent No.: US 8,677,771 B2
(45) Date of Patent: Mar. 25, 2014

(54) AIR COOLED REFRIGERATOR, METHOD AND SYSTEM OF CONTROLLING THE SAME

(75) Inventors: Lingyun Li, Anhui (CN); Wei Ren, Anhui (CN); Pansong Chen, Anhui (CN); Zhongcheng Fang, Anhui (CN)

(73) Assignees: Hefei Midea Rongshida Refrigerator Co., Ltd. (CN); Hefei Hualing Co., Ltd. (CN)

( * ) Notice: Subject to any disclaimer, the term of this patent is extended or adjusted under 35 U.S.C. 154(b) by 115 days.

(21) Appl. No.: 13/472,697

(22) Filed: May 16, 2012

(65) Prior Publication Data

US 2012/0222436 A1 Sep. 6, 2012

(30) Foreign Application Priority Data

Mar. 30, 2010 (CN) ..... 2010 1 0138403
Apr. 8, 2010 (CN) ..... 2010 2 0159347 U

(51) Int. Cl.
*F25D 17/04* (2006.01)

(52) U.S. Cl.
USPC ..... 62/186

(58) Field of Classification Search
USPC ..... 62/89, 186, 176.1, 407, 441, 513
See application file for complete search history.

(56) References Cited

U.S. PATENT DOCUMENTS

| | | | | |
|---|---|---|---|---|
| 5,775,124 | A * | 7/1998 | Park et al. | 62/408 |
| 6,367,273 | B2 * | 4/2002 | Takagi et al. | 62/230 |
| 7,334,430 | B2 * | 2/2008 | Kakehashi et al. | 62/513 |
| 2008/0178621 | A1 | 7/2008 | Kang | |

FOREIGN PATENT DOCUMENTS

| | | | |
|---|---|---|---|
| CN | 1912510 | A | 2/2007 |
| CN | 201203318 | Y | 3/2009 |
| CN | 101586898 | A | 11/2009 |
| JP | 2000088439 | A | 3/2000 |
| JP | 2005331239 | A | 12/2005 |
| KR | 20090074292 | A | 7/2009 |

OTHER PUBLICATIONS

International Search Report; Application No. PCT/CN2010/077844; Issued: Dec. 29, 2010; Mailing Date: Jan. 27, 2011; 4 pages.

* cited by examiner

*Primary Examiner* — Melvin Jones
(74) *Attorney, Agent, or Firm* — St. Onge Steward Johnston & Reens LLC

(57) ABSTRACT

A system and method of controlling an air-cooled refrigerator. The air-cooled refrigerator includes a refrigerating compartment, a refrigerating evaporator, and a refrigerating fan for circulating an air between the refrigerating evaporator and the refrigerating compartment. The method may include steps of: detecting a temperature $T_L$ in the refrigerating compartment; determining whether the temperature $T_L$ is greater than or equal to a first predetermined temperature $T_1$, and starting the refrigerating evaporator to refrigerate the refrigerating compartment and adjusting a rotating speed of the refrigerating fan to $r_1$ if the temperature $T_L \geq T_1$; determining whether the temperature $T_L$ is less than a second predetermined temperature $T_2$ if the temperature $T_L < T_1$; stopping the refrigerating evaporator and detecting a temperature $T_H$ of the refrigerating evaporator if the temperature $T_L < T_2$; and adjusting the rotating speed of the refrigerating fan according to the temperature $T_H$ to adjust a humidity in the refrigerating compartment.

15 Claims, 5 Drawing Sheets

AIR COOLED REFRIGERATOR, METHOD AND SYSTEM OF CONTROLLING THE SAME

CROSS-REFERENCE TO RELATED APPLICATIONS

The present application is a continuation of pending International patent application PCT/CN2010/077844, filed on Oct. 18, 2010, which designates the United States and claims priority from Chinese patent application 201020159347.8, filed on Apr. 8, 2010 and Chinese patent application 201010138403.4, filed on Mar. 30, 2010. The content of all prior applications is incorporated herein by reference.

FIELD OF THE INVENTION

The present disclosure relates to a method of controlling an air-cooled refrigerator, a system of controlling the air-cooled refrigerator and an air-cooled refrigerator comprising the system, and more particularly to a method of controlling a humidity in a refrigerating compartment of an air-cooled refrigerator, a system of controlling the humidity in the refrigerating compartment of the air-cooled refrigerator and an air-cooled refrigerator comprising the system.

BACKGROUND OF THE INVENTION

With a conventional air-cooled frostless refrigerator, normally, a single refrigerating system is adopted, that is, only one evaporator is disposed in a freezing compartment and a fan are used for providing cold air to the freezing compartment and a refrigerating compartment, and the cold air is controlled to enter into the refrigerating compartment by the opening and the closing of a damper. However, because there is only one evaporator, almost all the moistures in the refrigerating compartment are brought back to the evaporator in the freezing compartment via air circulation and are frosted, and consequently water needs to be discharged out of the refrigerator by heating and defrosting of a heating wire periodically. Therefore, the humidity in the refrigerating compartment is very low, moistures in stored food, especially vegetables, fruits, etc., may be easily lost, and the refreshing effect is poor, thus resulting in air drying of an epidermis of the food and loss of nutrients therein.

Accordingly, an air-cooled frostless refrigerator having two refrigerating systems is provided, in which two evaporators are disposed in a refrigerating compartment and a freezing compartment respectively so that airs in the refrigerating compartment and the freezing compartment are circulated separately. However, because certain treatment measures are not taken for the evaporators and working conditions of a fan in the refrigerating compartment are not optimized, although factors non-advantageous for a user such as tainting by odors among foods are alleviated, moistures in the refrigerating compartment are frosted on the evaporator and then discharged out of the refrigerator after the frost is heated and defrosted. Therefore, the humidity in the entire refrigerating compartment may not be ensured, and the refreshing time of the food may not be ensured.

SUMMARY OF THE INVENTION

The present disclosure is directed to solve at least one of the problems existing in the prior art. Accordingly, a method of controlling an air-cooled refrigerator, a system of controlling the air-cooled refrigerator and an air-cooled refrigerator comprising the system may need to be provided, which may control the humidity in a refrigerating compartment flexibly, avoid moisture loss in food, and/or improve the refreshing effect by appropriately controlling a refrigerating evaporator and a refrigerating fan.

According to a first aspect of the present disclosure, a method of controlling an air-cooled refrigerator may be provided. The air-cooled refrigerator may comprise a refrigerating compartment, a refrigerating evaporator, and a refrigerating fan for circulating an air between the refrigerating evaporator and the refrigerating compartment. The method may comprise steps of: detecting a temperature $T_L$ in the refrigerating compartment; determining whether the temperature $T_L$ is greater than or equal to a first predetermined temperature $T_1$, and starting the refrigerating evaporator to refrigerate the refrigerating compartment and adjusting a rotating speed of the refrigerating fan to $r_1$ if the temperature $T_L \geq T_1$; determining whether the temperature $T_L$ is less than a second predetermined temperature $T_2$ if the temperature $T_L < T_1$; stopping the refrigerating evaporator and detecting a temperature $T_H$ of the refrigerating evaporator if the temperature $T_L < T_2$; and adjusting the rotating speed of the refrigerating fan according to the temperature $T_H$ to adjust a humidity in the refrigerating compartment.

With the method of controlling the air-cooled refrigerator according to an embodiment of the present disclosure, a separate refrigerating evaporator and a separate refrigerating fan are disposed in the refrigerating compartment. The operation of the refrigerating evaporator may be controlled according to the temperature in the refrigerating compartment, and the rotating speed of the refrigerating fan may be adjusted according to the temperature of the refrigerating evaporator appropriately and flexibly, so that a higher humidity in the refrigerating compartment may be maintained, moisture loss of food in the refrigerating compartment may be reduced effectively, and the refreshing effect may be enhanced.

With the method of controlling the air-cooled refrigerator according to an embodiment of the present disclosure, most of defrosting water on the refrigerating evaporator may be brought into the refrigerating compartment, so that frosting on the refrigerating evaporator may be relatively reduced. Therefore, the defrosting period of the refrigerating compartment may be prolonged, or the total working times of a heating wire in the refrigerating compartment within a time unit may be decreased, thus reducing electric energy consumption.

Further, the first predetermined temperature $T_1$ is a maximum allowable temperature in the refrigerating compartment, and the second predetermined temperature $T_2$ is a minimum allowable temperature in the refrigerating compartment.

Alternatively, if $T_2 \leq T_L < T_1$, the refrigerating evaporator continues operating, and the rotating speed of the refrigerating fan is maintained at $r_1$.

Further, the step of adjusting the rotating speed of the refrigerating fan comprises decreasing the rotating speed of the refrigerating fan stage by stage with an increase of the temperature $T_H$.

Particularly, the step of adjusting the rotating speed of the refrigerating fan further comprises: adjusting the rotating speed of the refrigerating fan to $r_2$ if $T_H < t_3$; adjusting the rotating speed of the refrigerating fan to $r_3$ if $t_3 \leq T_H < t_4$; and adjusting the rotating speed of the refrigerating fan to $r_4$ if $T_H \geq t_4$, where $t_3$ is a third predetermined temperature, $t_4$ is a fourth predetermined temperature, and $r_4 < r_3 < r_2 < r_1$.

Alternatively, the step of adjusting the rotating speed of the refrigerating fan comprises decreasing the rotating speed of the refrigerating fan gradually with an increase of the temperature $T_H$.

According to a second aspect of the present disclosure, a system of controlling an air-cooled refrigerator may be provided. The air-cooled refrigerator may comprise a refrigerating compartment, a refrigerating evaporator, and a refrigerating fan for circulating an air between the refrigerating evaporator and the refrigerating compartment. The system may comprise: a refrigerating compartment temperature detecting unit for detecting a temperature $T_L$ in the refrigerating compartment; a refrigerating compartment temperature determining unit for determining whether $T_2 \leq T_L < T_1$, where $T_1$ is a first predetermined temperature, and $T_2$ is a second predetermined temperature; a refrigerating evaporator temperature detecting unit for detecting a temperature $T_H$ of the refrigerating evaporator; and a control unit for starting the refrigerating evaporator to refrigerate the refrigerating compartment and adjusting a rotating speed of the refrigerating fan to $r_1$ if $T_L \geq T_1$, and stopping an operation of the refrigerating evaporator and adjusting the rotating speed of the refrigerating fan according to the temperature $T_H$ to adjust a humidity in the refrigerating compartment if $T_L < T_2$.

Alternatively, if $T_2 \leq T_L < T_1$, the refrigerating evaporator is controlled by the control unit to continue operating, and the rotating speed of the refrigerating fan is maintained at $r_1$.

Further, the rotating speed of the refrigerating fan is decreased by the control unit stage by stage with an increase of the temperature $T_H$.

Particularly, the system may further comprise a refrigerating evaporator temperature determining unit for determining the temperature of the refrigerating evaporator, in which the rotating speed of the refrigerating fan is adjusted to $r_2$ by the control unit if it is determined by the refrigerating evaporator temperature determining unit that $T_H < t_3$, the rotating speed of the refrigerating fan is adjusted to $r_3$ by the control unit if it is determined by the refrigerating evaporator temperature determining unit that $t_3 \leq T_H < t_4$, and the rotating speed of the refrigerating fan is adjusted to $r_4$ by the control unit if it is determined by the refrigerating evaporator temperature determining unit that $T_H \geq t_4$, where $t_3$ is a third predetermined temperature, $t_4$ is a fourth predetermined temperature, and $r_4 < r_3 < r_2 < r_1$.

According to a third aspect of the present disclosure, an air-cooled refrigerator may comprise: a refrigerating compartment; a refrigerating evaporator; and a refrigerating fan for circulating an air between the refrigerating evaporator and the refrigerating compartment, in which the air-cooled refrigerator further comprises a system according to the second aspect of the present disclosure.

The air-cooled refrigerator according to the third aspect of the present disclosure may further comprise a freezing compartment, a freezing evaporator, and a switching unit, in which the switching unit is connected with the freezing evaporator via a freezing capillary tube, the refrigerating evaporator is connected with the switching unit via a refrigerating capillary tube, the refrigerating evaporator and the refrigerating capillary tube are connected with the freezing capillary tube in parallel, and the switching unit is controlled by the control unit to selectively supply a refrigerant to the refrigerating evaporator, to start or stop the refrigerating of the refrigerating compartment.

The refrigerating evaporator comprises a coil pipe and a plurality of fins, the coil pipe is extended into a corrugated shape in a longitudinal direction to form a plurality of layers of pipe segments in a lateral direction perpendicular to the longitudinal direction, the plurality of fins are arranged in the lateral direction and connected with the coil pipe respectively, and at least a part of the fins have at least a break point in the longitudinal direction to be discontinuous in the longitudinal direction.

Alternatively, each fin has a plurality of break points between two adjacent layers of pipe segments.

Particularly, each fin is formed with a plurality of via holes through which the plurality of the layers of the pipe segments are penetrated respectively.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION OF THE INVENTION

Figure 1:
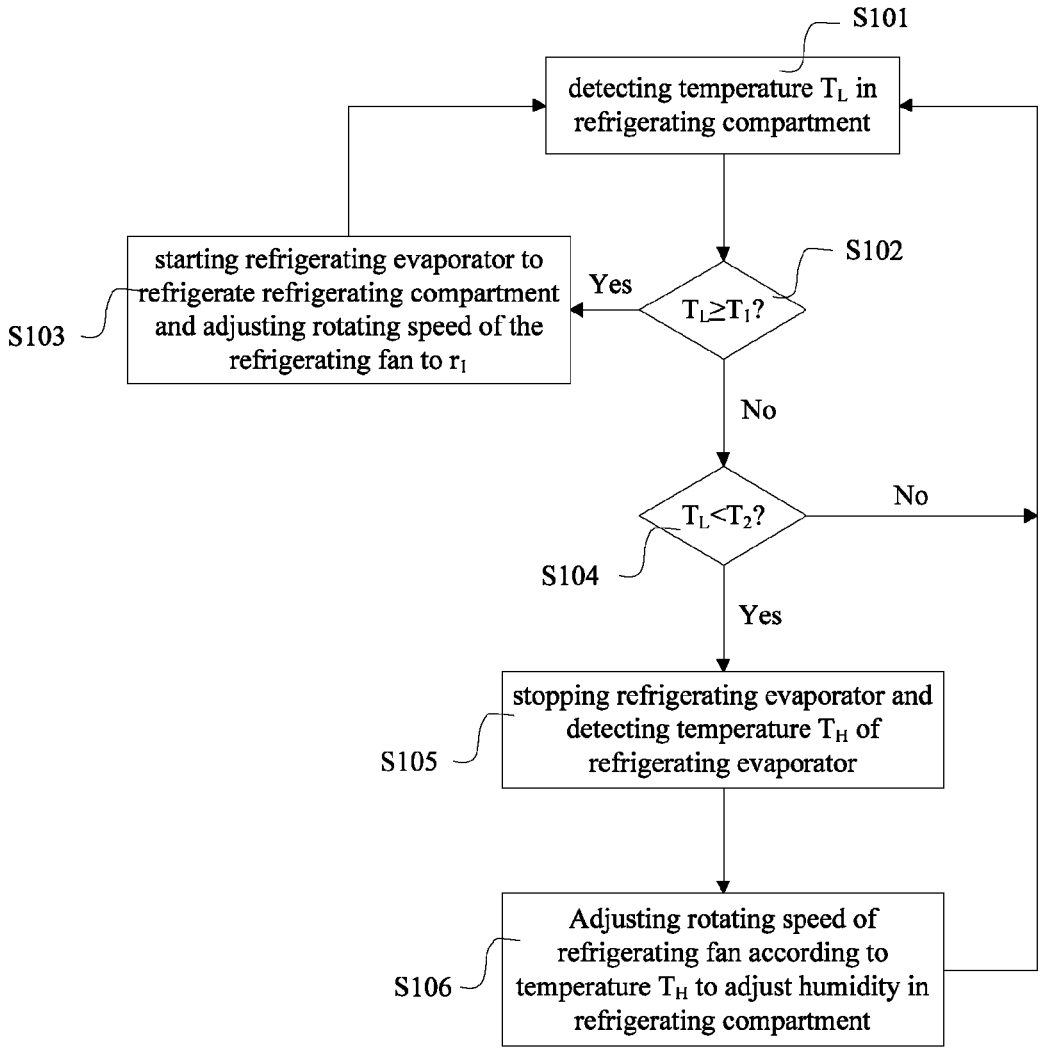
FIG. 1 is a flow chart of a method of controlling an air-cooled refrigerator according to an embodiment of the present disclosure.

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

It is to be understood that phraseology and terminology used herein with reference to device or element orientation (such as, terms like "longitudinal", "lateral", "front", "rear", "right", "left", "lower", "upper", "horizontal", "vertical", "above", "below", "up", "top", "bottom" as well as derivative thereof such as "horizontally", "downwardly", "upwardly", etc.) are only used to simplify description of the present invention, and do not alone indicate or imply that the device or element referred to must have or operated in a particular orientation.

Figure 5:
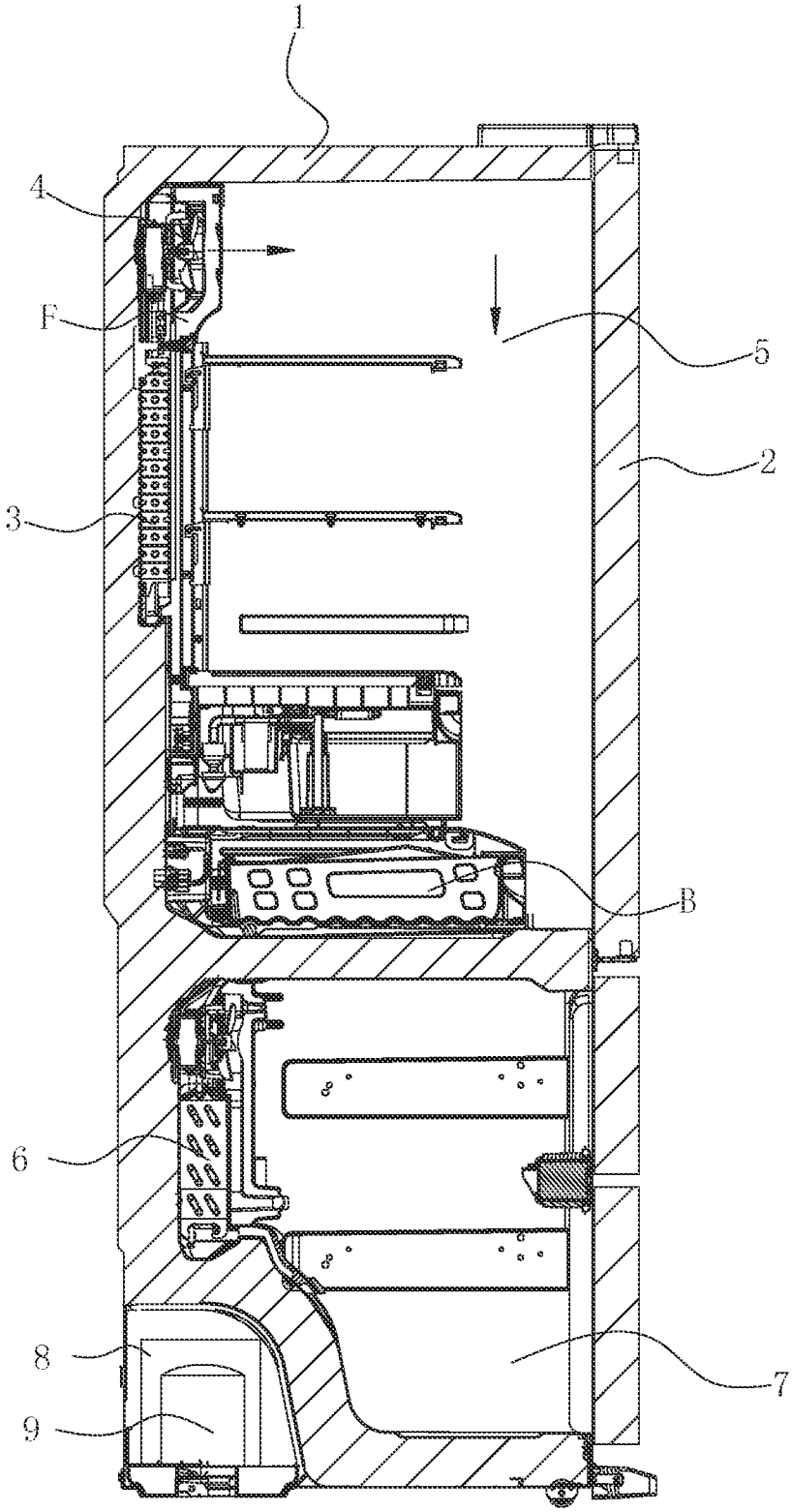
FIG. 5 is a schematic cross-sectional view of an air-cooled refrigerator according to an embodiment of the present disclosure.

An air-cooled refrigerator according to an embodiment of the present disclosure will be described below with reference to FIG. 5. As shown in FIG. 5, the air-cooled refrigerator according to an embodiment of the present disclosure comprises a body 1 and a door 2. The body 1 defines a refrigerating compartment 5 located in an upper portion thereof and a freezing compartment 7 located in a lower portion thereof. Alternatively, a temperature change compartment B may also be disposed between the refrigerating compartment 5 and the freezing compartment 7. A refrigerating evaporator 3 is disposed at a back surface (left side in FIG. 5) of the refrigerating compartment 5, a refrigerating air passage F is disposed between the refrigerating evaporator 3 and the refrigerating compartment 5, foam materials (not shown) may be disposed in the refrigerating air passage F, and a refrigerating fan 4 is disposed between the refrigerating air passage F and the refrigerating compartment 5 for transferring a cold air generated in the refrigerating evaporator 3 to the refrigerating compartment 5. In the embodiment shown in FIG. 5, the temperature change compartment B is also refrigerated by the cold air generated in the refrigerating evaporator 3, however, the present disclosure is not limited to this.

A freezing evaporator 6 is disposed at a back surface of the freezing compartment 7. A compressor 9 is provided at the bottom of the body 1, and a condenser 8 is disposed at the right side of the compressor 9 at the bottom of the body 1.

Figure 4:
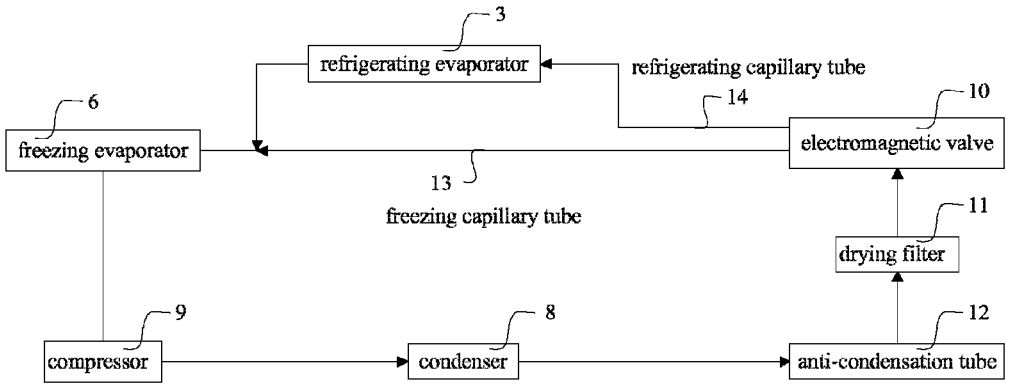
FIG. 4 is a schematic diagram of a system of controlling an air-cooled refrigerator according to an embodiment of the present disclosure.

The system of controlling the air-cooled refrigerator according to an embodiment of the present disclosure will be described hereinafter with reference to FIG. 4. As shown in FIG. 4, the refrigerating evaporator 3 and the freezing evaporator 6 are disposed in one refrigerating system, and the compressor 9, the condenser 8, an anti-condensation tube 12, a drying filter 11, an electromagnetic valve 10 as a switching unit, and the freezing evaporator 6 are connected, in which the electromagnetic valve 10 is connected with the freezing evaporator 6 via a freezing capillary tube 13. In addition, the electromagnetic valve 10 is also connected with the refrigerating evaporator 3 via a refrigerating capillary tube 14, and the refrigerating evaporator 3 and the refrigerating capillary tube 14 are connected with the freezing capillary tube 13 in parallel. The electromagnetic valve 10 is used for supplying a refrigerant to the refrigerating evaporator 3 selectively, thus controlling the refrigerating of the refrigerating compartment 5 selectively.

With the air-cooled refrigerator according to an embodiment of the present disclosure, the refrigerating compartment 5 and the freezing compartment 7 are refrigerated by individual evaporators respectively, and only one refrigerating system is used, thus decreasing the total number of the members and reducing the cost accordingly.

Figure 6:
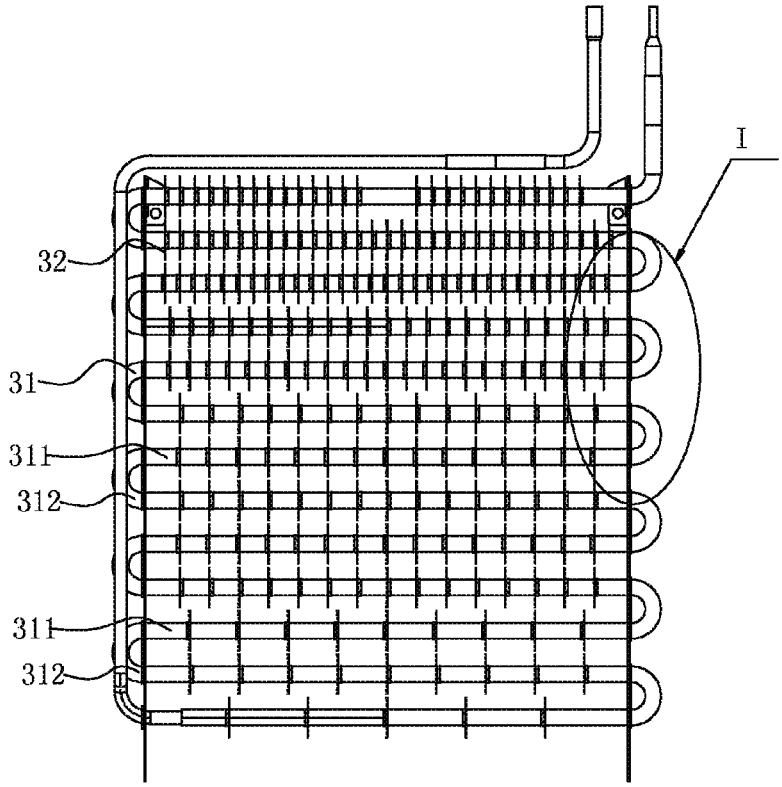
FIG. 6 is a schematic view of a refrigerating evaporator of an air-cooled refrigerator according to an embodiment of the present disclosure.
Figure 7:
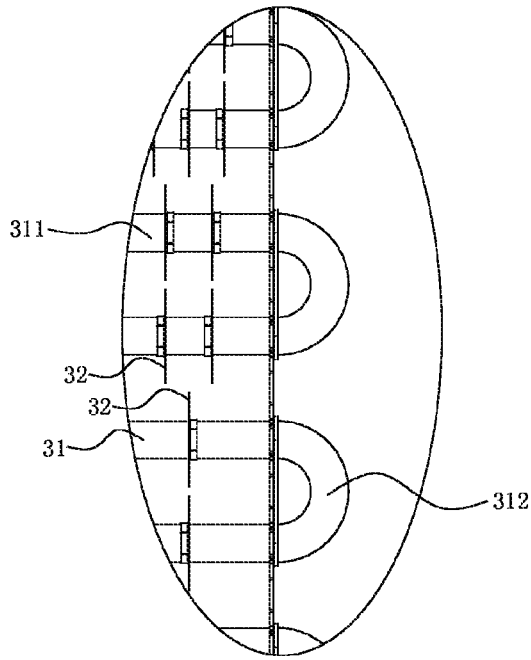
FIG. 7 is an enlarged schematic view of the part I shown in FIG. 6.

In some embodiments, as shown in FIGS. 6-7, the refrigerating evaporator 3 comprises a coil pipe 31 and a plurality of fins 32. The coil pipe 31 is extended into a corrugated shape in a longitudinal direction, the vertical direction in FIG. 6, to form a plurality of layers of pipe segments 311 in the longitudinal direction. And adjacent layers of the pipe segments 311 are connected with each other via an arcuate transition pipe segment 312 so that two adjacent layers of pipe segments 311 and the arcuate transition pipe segment 312 form into a substantially U shape. The plurality of fins 32 are arranged in a lateral direction, i.e. the left-to-right direction in FIG. 6, and connected with the plurality of layers of pipe segments 311 respectively, and at least a part of the fins 32 is discontinuous in the longitudinal direction. In some embodiments, the fact that at least a part of the fins 32 is discontinuous in the longitudinal direction may be achieved by disposing a break point in one integral fin. Alternatively, the fins 32 connected on each layer of pipe segment 311 may be individual ones, so that the fins 32 connected with the plurality of layers of pipe segments 311 respectively are discontinuous in the longitudinal direction.

In some specific examples, as shown in FIG. 6, each fin 32 has a plurality of break points between two adjacent layers of pipe segments 311 in the longitudinal direction, so that each fin 32 is formed by a plurality of segments which are discontinuous in the longitudinal direction.

In a specific example, each fin 32 is formed with a plurality of via holes (not shown) through which the plurality of the layers of the pipe segments 311 are penetrated respectively so as to connect the plurality of fins 32 with the plurality of the layers of the pipe segments 311 respectively. Alternatively, the plurality of fins 32 may be welded to the plurality of the layers of the pipe segments 311 respectively.

With the air-cooled refrigerator according to an embodiment of the present disclosure, because the fins 32 have a structure which is discontinuous in the longitudinal direction, the surface tension of water may be used to form small water drops at a bottom end of each fin 32, thus avoiding loss of moistures caused by flow and accumulation of water drops along conventional fins which are continuous in the longitudinal direction and prolonging the time period during which water drops remain on the refrigerating evaporator 3. Moreover, the small water drops may be brought into the refrigerating compartment 5 by the way of water vapor circulation, so that a higher humidity in the refrigerating compartment 5 may be maintained. For example, small water drops generated during defrosting on the plurality of fins 32 may be converted into water vapors and brought into the refrigerating compartment 5 by the refrigerating fan 4, thus reducing loss of moistures in the refrigerating compartment 5 effectively and avoiding the fact that water drops flow downwards quickly along the conventional fins which are continuous in the longitudinal direction and then are accumulated in a water-containing plate in a bottom of the air-cooled refrigerator to be discharged out of the body 1. Therefore, the refrigerating compartment 5 may be in a high-humidity state, moisture loss in food may be reduced, the refreshing time of the food may be prolonged, and the refreshing performance of the refrigerating compartment 5 may be improved significantly.

The method and system of controlling the air-cooled refrigerator according to an embodiment of the present disclosure will be described below with reference to FIGS. 1-3. With the method and the system of controlling the air-cooled refrigerator according to an embodiment of the present disclosure, the rotating speed of the refrigerating fan 4 may be appropriately and flexibly adjusted according to the temperature of the refrigerating evaporator 3, so that defrosting water on the refrigerating evaporator 3 may be sent into the refrigerating compartment 5 and the humidity in the refrigerating compartment 5 may be maintained.

As shown in FIG. 1, the method of controlling the air-cooled refrigerator for maintaining the humidity in the refrigerating compartment 5 according to an embodiment of the present disclosure comprises the following steps.

First, a temperature $T_L$ in the refrigerating compartment 5 is detected (step S101).

Then, it is determined whether the temperature $T_L$ in the refrigerating compartment 5 is greater than or equal to a first predetermined temperature $T_1$ (step S102). If $T_L \geq T_1$, the refrigerating evaporator 3 is started to refrigerate the refrigerating compartment 5 and a rotating speed of the refrigerating fan 4 is adjusted to $r_1$ (step S103).

If the temperature $T_L < T_1$, it is determined whether the temperature $T_L$ is less than a second predetermined temperature $T_2$ (step S104).

If the temperature $T_L<T_2$, the refrigerating evaporator 3 is stopped and a temperature $T_H$ of the refrigerating evaporator 3 is detected (step S105).

Finally, the rotating speed of the refrigerating fan 4 is adjusted according to the temperature $T_H$ of the refrigerating evaporator 3 to adjust a humidity in the refrigerating compartment 5 (step S106).

With the method of controlling the air-cooled refrigerator according to an embodiment of the present disclosure, when the temperature in the refrigerating compartment 5 is greater than or equal to the first predetermined temperature $T_1$, the refrigerating evaporator 3 is started to refrigerate the refrigerating compartment 5. When the temperature in the refrigerating compartment 5 meets normal needs, the refrigerating evaporator 3 is stopped, but the refrigerating fan 4 is not stopped at this time but continues operating to send defrosting water on the surface of the refrigerating evaporator 3 into the refrigerating compartment 5 and adjust the rotating speed of the refrigerating fan 4 according to the temperature of the refrigerating evaporator 3. Therefore, a higher humidity in the refrigerating compartment 5 may be maintained, moisture loss in food in the refrigerating compartment 5 may be reduced, and the refreshing effect may be enhanced. Moreover, frosting on the refrigerating evaporator 3 may be relatively reduced, thus prolonging the defrosting period of the refrigerating compartment 5, that is, decreasing the working times of a heating wire in the refrigerating compartment 5 per time unit. Therefore, electric energy consumption may be reduced, and the effect of saving energy may be achieved.

In some embodiments, the first predetermined temperature $T_1$ is a maximum allowable temperature in the refrigerating compartment 5, and the second predetermined temperature $T_2$ is a minimum allowable temperature in the refrigerating compartment 5. For example, if the temperature in the refrigerating compartment 5 is usually between 1 Celsius degree and 6 Celsius degrees, then the first predetermined temperature $T_1$ may be determined to be 6 Celsius degrees, and the second predetermined temperature $T_2$ may be 1 Celsius degree.

In some embodiments, if $T_2 \leq T_L < T_1$, for example, the temperature in the refrigerating compartment 5 is decreased from $T_1$ to $T_2$, then the refrigerating evaporator 3 continues operating, and the rotating speed of the refrigerating fan 4 is maintained at $r_1$, until $T_L$ is less than $T_2$. The operation of the refrigerating evaporator 3 is stopped when $T_L$ is less than $T_1$. Alternatively, when $T_2 \leq T_L < T_1$, the operation of the refrigerating evaporator 3 may also be stopped.

In some embodiments, the step of adjusting the rotating speed of the refrigerating fan 4 comprises decreasing the rotating speed of the refrigerating fan 4 gradually with an increase of the temperature $T_H$. In other words, the higher the temperature of the refrigerating evaporator 3, the lower the rotating speed of the refrigerating fan 4 is, and the higher the humidity in the refrigerating compartment 5.

The method of controlling the air-cooled refrigerator according to another embodiment of the present disclosure will be described below with reference to FIG. 1. In the embodiment shown in FIG. 2, the step of adjusting the rotating speed of the refrigerating fan 4 comprises decreasing the rotating speed of the refrigerating fan 4 stage by stage with an increase of the temperature $T_H$.

Figure 2:
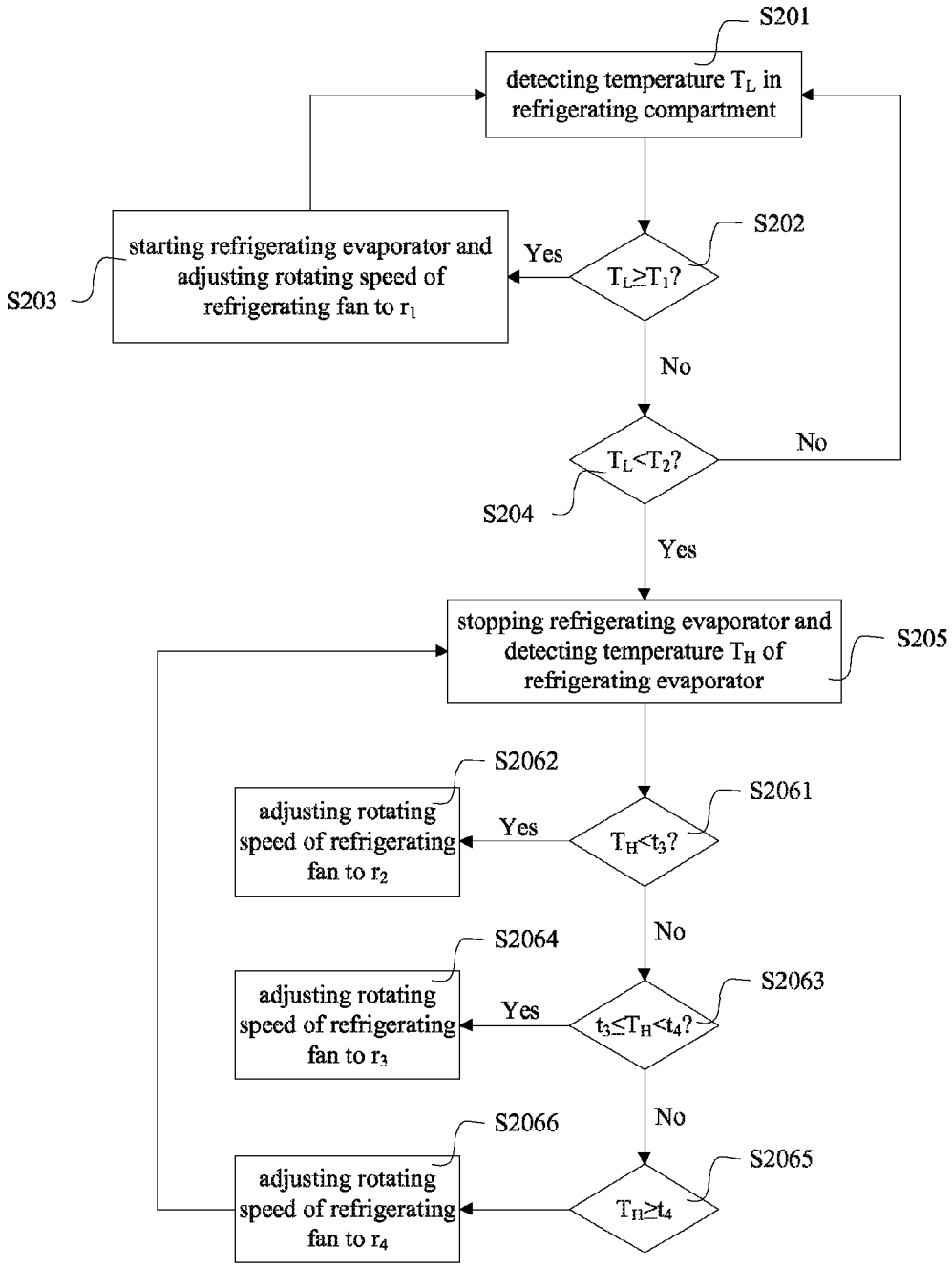
FIG. 2 is a flow chart of a method of controlling an air-cooled refrigerator according to another embodiment of the present disclosure.

More particularly, as shown in FIG. 2, the method of controlling the air-cooled refrigerator according to another embodiment of the present disclosure comprises the following steps.

First, a temperature $T_L$ in the refrigerating compartment 5 is detected (step S201).

Then, it is determined whether the temperature $T_L$ in the refrigerating compartment 5 is greater than or equal to a first predetermined temperature $T_1$ (step S202). If $T_L \geq T_1$, the refrigerating evaporator 3 is started to refrigerate the refrigerating compartment 5 and a rotating speed of the refrigerating fan 4 is adjusted to $r_1$ (step S203).

If the temperature $T_L<T_1$, it is determined whether the temperature $T_L$ is less than a second predetermined temperature $T_2$ (step S204).

If the temperature $T_L<T_2$, the refrigerating evaporator 3 is stopped and a temperature $T_H$ of the refrigerating evaporator 3 is detected (step S205).

Next, the rotating speed of the refrigerating fan 4 is adjusted according to the temperature $T_H$ of the refrigerating evaporator 3 to adjust a humidity in the refrigerating compartment 5. More particularly, it is determined whether $T_H$ is less than $t_3$ (step S2601), and the rotating speed of the refrigerating fan 4 is adjusted to $r_2$ if $T_H<t_3$ (step S2602). If $T_H$ is not less than $t_3$, it is determined whether $T_H$ is less than $t_4$ (step S2603), and the rotating speed of the refrigerating fan 4 is adjusted to $r_3$ if $t_3 \leq T_H < t_4$ (step S2604). If $T_H$ is not less than $t_4$, it is determined that $T_H \geq t_4$ (step S2605), and the rotating speed of the refrigerating fan 4 is adjusted to $r_4$ (step S2606). $t_3$ is a third predetermined temperature, $t_4$ is a fourth predetermined temperature, and $r_4<r_3<r_2<r_1$.

In the above embodiment, the rotating speed of the refrigerating fan 4 is adjusted according to the temperature $T_H$ of the refrigerating evaporator 3 stage by stage, in which the temperature $T_H$ of the refrigerating evaporator 3 is divided into three stages. It would be appreciated that the present disclosure is not limited to this, and any suitable quantity of stages may be divided according to applications.

According to the above embodiment of the present disclosure, the rotating speed of the refrigerating fan 4 may be adjusted according to the temperature $T_H$ of the refrigerating evaporator 3 stage by stage and flexibly, thus ensuring the humidity in the refrigerating compartment 5 and improving the freshness in the refrigerating compartment 5.

The system of controlling the air-cooled refrigerator according to an embodiment of the present disclosure will be described below with reference to FIG. 3. As shown in FIG. 3, the system of controlling the air-cooled refrigerator according to an embodiment of the present disclosure comprises a refrigerating compartment temperature detecting unit 18, a refrigerating compartment temperature determining unit 19 connected with the refrigerating compartment temperature detecting unit 18, a refrigerating evaporator temperature detecting unit 20, and a control unit 15.

The refrigerating compartment temperature detecting unit 18 is, for example, a temperature sensor for detecting a temperature $T_L$ in the refrigerating compartment 5. The refrigerating compartment temperature determining unit 19 is used for determining whether $T_2 \leq T_L < T_1$. The refrigerating evaporator temperature detecting unit 20 is used for detecting a temperature $T_H$ of the refrigerating evaporator 3.

The control unit 15 is used for starting the refrigerating evaporator 3 to refrigerate the refrigerating compartment 5 and adjusting a rotating speed of the refrigerating fan 4 to $r_1$ if $T_L \geq T_1$, and stopping an operation of the refrigerating evaporator 3 and adjusting the rotating speed of the refrigerating fan 4 according to the temperature $T_H$ to adjust a humidity in the refrigerating compartment 5 if $T_L<T_2$.

Figure 3:
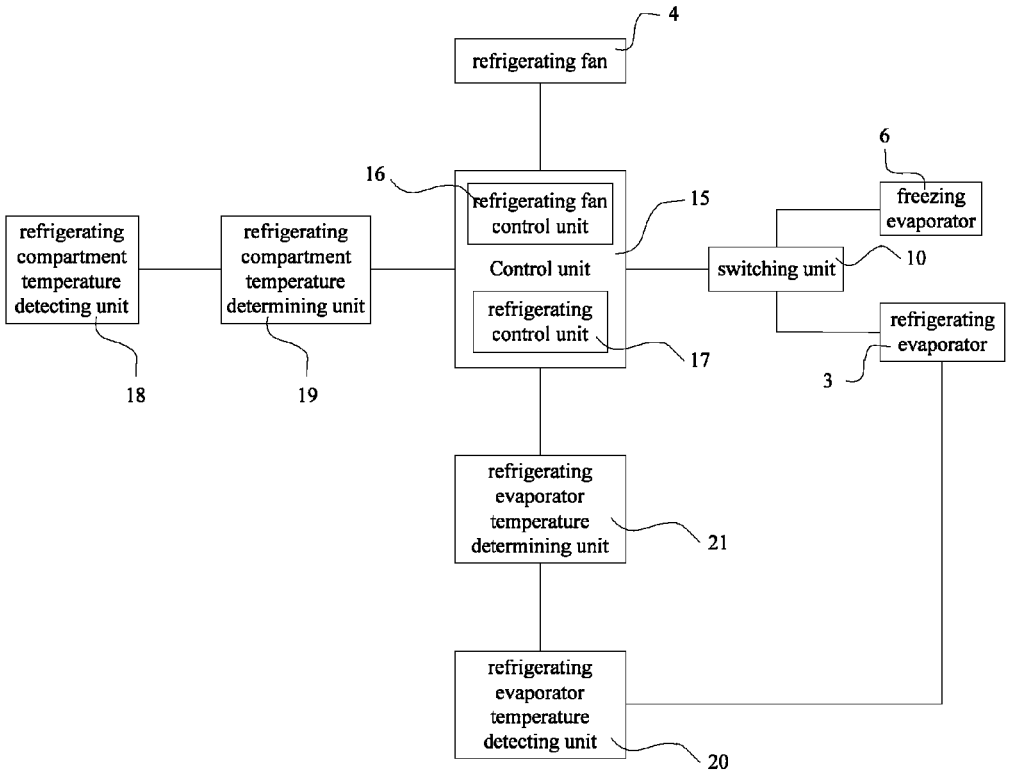
FIG. 3 is a block diagram of a system of controlling an air-cooled refrigerator according to an embodiment of the present disclosure.

In some embodiments, as shown in FIG. 3, particularly, the control unit 15 may comprise a refrigerating control unit 17 and a refrigerating fan control unit 16. The refrigerating control unit 17 is used for controlling the operation and the stopping of the refrigerating evaporator 3, and the refrigerating fan control unit 16 is used for controlling the refrigerating fan 4.

Alternatively, if $T_2 \leq T_L < T_1$, the refrigerating evaporator 3 is controlled by the control unit 15 to continue operating, and the rotating speed of the refrigerating fan 4 is maintained at $r_1$.

The rotating speed of the refrigerating fan 4 may be decreased by the control unit 15 gradually or stage by stage with an increase of the temperature $T_H$.

In one example, the control unit 15 may further comprise a refrigerating evaporator temperature determining unit 21 for determining the temperature $T_H$ of the refrigerating evaporator 3. For example, the rotating speed of the refrigerating fan 4 is adjusted to $r_2$ by the control unit 15 if it is determined by the refrigerating evaporator temperature determining unit 21 that $T_H < t_3$, the rotating speed of the refrigerating fan 4 is adjusted to $r_3$ by the control unit 15 if it is determined by the refrigerating evaporator temperature determining unit 21 that $t_3 \leq T_H < t_4$, and the rotating speed of the refrigerating fan 4 is adjusted to $r_4$ by the control unit 15 if it is determined by the refrigerating evaporator temperature determining unit 21 that $T_H \geq t_4$, where $t_3$ is a third predetermined temperature, $t_4$ is a fourth predetermined temperature, and $r_4 < r_3 < r_2 < r_1$.

With the system of controlling the air-cooled refrigerator according to an embodiment of the present disclosure, the rotating speed of the refrigerating fan 4 may be adjusted according to the temperature of the refrigerating evaporator 3, so that defrosting water on the refrigerating evaporator 3 may be sent into the refrigerating compartment 5. Therefore, a higher humidity in the refrigerating compartment 5 may be maintained, moisture loss in food in the refrigerating compartment 5 may be reduced, and the refreshing effect may be enhanced. Moreover, frosting on the refrigerating evaporator 3 may be relatively reduced, thus prolonging the defrosting period of the refrigerating compartment 5, that is, decreasing the working times of a heating wire in the refrigerating compartment 5 per time unit. Therefore, electric energy consumption may be reduced, and the effect of saving energy may be achieved.

It should be noted that in the above description, the control unit 15, the refrigerating compartment temperature determining unit 19 and the refrigerating evaporator temperature determining unit 21 may be separately provided. However, it would be appreciated by those skilled in the art that the control unit 15, the refrigerating compartment temperature determining unit 19 and the refrigerating evaporator temperature determining unit 21 may be integrated in a single chip.

The air-cooled refrigerator according to an embodiment of the present disclosure may comprise the above-mentioned system. The operation of the air-cooled refrigerator according to an embodiment of the present disclosure will be simply described below.

When the temperature in each of the refrigerating compartment 5 and the freezing compartment 7 are higher than a predetermined temperature and the refrigerating compartment 5 and the freezing compartment 7 need to be refrigerated, the compressor 9 is started by the control unit 15, and the refrigerant is switched into the refrigerating capillary tube 14 by the switching unit (electromagnetic valve) 10, flows into the refrigerating evaporator 3 from the refrigerating capillary tube 14, and then flows into the freezing evaporator 6 from the refrigerating evaporator 3, thus refrigerating the refrigerating compartment 5 and the freezing compartment 7. At this time, the rotating speed of the refrigerating fan 4 is controlled to be $r_1$ by the control unit 15. When the refrigerating compartment 5 does not need to be refrigerated but the freezing compartment 7 needs to be refrigerated, the refrigerant is switched into the freezing capillary tube 13 by the electromagnetic valve 10 under the control of the control unit 15, and flows into the freezing evaporator 6 to refrigerate the freezing compartment 7. Because no refrigerants flow into the refrigerating evaporator 3, the refrigerating compartment 5 is not refrigerated. When neither the refrigerating compartment 5 nor the freezing compartment 7 needs to be refrigerated, the operation of the compressor 9 is stopped by the control unit 15.

When the refrigerating compartment 5 is not refrigerated, the temperature $T_H$ of the refrigerating evaporator 3 is detected by the refrigerating evaporator temperature detecting unit 20, the rotating speed of the refrigerating fan 4 is adjusted to $r_2$ by the control unit 15 if $T_H < t_3$, the rotating speed of the refrigerating fan 4 is adjusted to $r_3$ by the control unit 15 if $t_3 \leq T_H < t_4$, and the rotating speed of the refrigerating fan 4 is adjusted to $r_4$ by the control unit 15 if $T_H \geq t_4$. Therefore, defrosting water on the refrigerating evaporator 3 may be sent into the refrigerating compartment 5 by the refrigerating fan 4, thus maintaining the humidity and the freshness in the refrigerating compartment 5.

According to an embodiment of the present disclosure, separate evaporators and separate air passages are disposed in the refrigerating compartment and the freezing compartment of the air-cooled refrigerator respectively, and the working state of the refrigerating fan is adjusted in an appropriate and flexible manner, so that the refrigerating compartment may be in a high-humidity state, moisture loss in food may be reduced, and the refreshing time of the food may be prolonged. Therefore, the refreshing performance of the refrigerating compartment may be improved significantly. Meanwhile, because the refrigerating compartment and the freezing compartment have separate air passage circulation systems, tainting by odors among foods may be avoided, thus further meeting the requirement of the user.

Moreover, because defrosting water on the refrigerating evaporator 3 may be sent into the refrigerating compartment 5 by the refrigerating fan 4, a higher humidity in the refrigerating compartment 5 may be maintained, moisture loss in food in the refrigerating compartment 5 may be reduced, and the refreshing effect may be enhanced. Moreover, frosting on the refrigerating evaporator 3 may be relatively reduced, thus prolonging the defrosting period of the refrigerating compartment 5, that is, decreasing the working times of a heating wire in the refrigerating compartment 5 per time unit. Therefore, electric energy consumption may be reduced, and the effect of saving energy may be achieved accordingly.

Reference throughout this specification to "an embodiment", "some embodiments", "one embodiment", "an example", "a specific examples", or "some examples" means that a particular feature, structure, material, or characteristic described in connection with the embodiment or example is included in at least one embodiment or example of the disclosure. Thus, the appearances of the phrases such as "in some embodiments", "in one embodiment", "in an embodiment", "an example", "a specific examples", or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. A system of controlling an air-cooled refrigerator, the air-cooled refrigerator comprising a refrigerating compartment, a refrigerating evaporator, and a refrigerating fan for circulating an air between the refrigerating evaporator and the refrigerating compartment, the system comprising:

a refrigerating compartment temperature detecting unit for detecting a temperature $T_L$ in the refrigerating compartment;

a refrigerating compartment temperature determining unit for determining whether $T_2 \leq T_L < T_1$, where $T_1$ is a first predetermined temperature, and $T_2$ is a second predetermined temperature;

a refrigerating evaporator temperature detecting unit for detecting a temperature $T_H$ of the refrigerating evaporator; and a control unit for starting the refrigerating evaporator to refrigerate the refrigerating compartment and adjusting a rotating speed of the refrigerating fan to $r_1$ if $T_L \geq T_1$, and stopping an operation of the refrigerating evaporator and adjusting the rotating speed of the refrigerating fan according to the temperature $T_H$ to adjust a humidity in the refrigerating compartment if $T_L < T_2$.

2. The system according to claim 1, wherein if $T_2 \leq T_L < T_1$, the refrigerating evaporator is controlled by the control unit to continue operating, and the rotating speed of the refrigerating fan is maintained at $r_1$.

3. The system according to claim 1, wherein the rotating speed of the refrigerating fan is decreased by the control unit stage by stage with an increase of the temperature $T_H$.

4. The system according to claim 3, further comprising a refrigerating evaporator temperature determining unit for determining the temperature of the refrigerating evaporator, wherein the rotating speed of the refrigerating fan is adjusted to $r_2$ by the control unit if it is determined by the refrigerating evaporator temperature determining unit that $T_H < t_3$, the rotating speed of the refrigerating fan is adjusted to $r_3$ by the control unit if it is determined by the refrigerating evaporator temperature determining unit that $t_3 \leq T_H < t_4$, and the rotating speed of the refrigerating fan is adjusted to $r_4$ by the control unit if it is determined by the refrigerating evaporator temperature determining unit that $T_H \geq t_4$, where $t_3$ is a third predetermined temperature, $t_4$ is a fourth predetermined temperature, and $r_4 < r_3 < r_2 < r_1$.

5. An air-cooled refrigerator comprising:

a refrigerating compartment;

a refrigerating evaporator; and a refrigerating fan for circulating an air between the refrigerating evaporator and the refrigerating compartment, wherein the air-cooled refrigerator further comprises a system according to claim 1.

6. The air-cooled refrigerator according to claim 5, further comprising a freezing compartment, a freezing evaporator, and a switching unit, wherein the switching unit is connected with the freezing evaporator via a freezing capillary tube, the refrigerating evaporator is connected with the switching unit via a refrigerating capillary tube, the refrigerating evaporator and the refrigerating capillary tube are connected with the freezing capillary tube in parallel, and the switching unit is controlled by the control unit to selectively supply a refrigerant to the refrigerating evaporator, to start or stop the refrigerating of the refrigerating compartment.

7. The air-cooled refrigerator according to claim 5, wherein the refrigerating evaporator comprises a coil pipe and a plurality of fins, the coil pipe is extended into a corrugated shape in a longitudinal direction to form a plurality of layers of pipe segments in the longitudinal direction, the plurality of fins are arranged in a lateral direction and connected with the coil pipe respectively, and wherein at least a part of the fins have at least a break point in the longitudinal direction to be discontinuous in the longitudinal direction.

8. The air-cooled refrigerator according to claim 7, wherein each fin has a plurality of break points between two adjacent layers of pipe segments.

9. The air-cooled refrigerator according to claim 8, wherein each fin is formed with a plurality of via holes through which the plurality of the layers of the pipe segments are penetrated respectively.

10. A method of controlling an air-cooled refrigerator, the air-cooled refrigerator comprising a refrigerating compartment, a refrigerating evaporator, and a refrigerating fan for circulating an air between the refrigerating evaporator and the refrigerating compartment, the method comprising steps of:

detecting a temperature $T_L$ in the refrigerating compartment;

determining whether the temperature $T_L$ is greater than or equal to a first predetermined temperature $T_1$, and starting the refrigerating evaporator to refrigerate the refrigerating compartment and adjusting a rotating speed of the refrigerating fan to $r_1$ if the temperature $T_L \geq T_1$;

determining whether the temperature $T_L$ is less than a second predetermined temperature $T_2$ if the temperature $T_L < T_1$;

stopping the refrigerating evaporator and detecting a temperature $T_H$ of the refrigerating evaporator if the temperature $T_L < T_2$; and adjusting the rotating speed of the refrigerating fan according to the temperature $T_H$ to adjust a humidity in the refrigerating compartment.

11. The method according to claim 10, wherein the first predetermined temperature $T_1$ is a maximum allowable temperature in the refrigerating compartment, and the second predetermined temperature $T_2$ is a minimum allowable temperature in the refrigerating compartment.

12. The method according to claim 10, wherein if $T_2 \leq T_L < T_1$, the refrigerating evaporator continues operating, and the rotating speed of the refrigerating fan is maintained at $r_1$.

13. The method according to claim 10, wherein the step of adjusting the rotating speed of the refrigerating fan comprises decreasing the rotating speed of the refrigerating fan stage by stage with an increase of the temperature $T_H$.

14. The method according to claim 13, wherein the step of adjusting the rotating speed of the refrigerating fan further comprises:

adjusting the rotating speed of the refrigerating fan to $r_2$ if $T_H < t_3$;

adjusting the rotating speed of the refrigerating fan to $r_3$ if $t_3 \leq T_H < t_4$; and adjusting the rotating speed of the refrigerating fan to $r_4$ if $T_H \geq t_4$, where $t_3$ is a third predetermined temperature, $t_4$ is a fourth predetermined temperature, and $r_4 < r_3 < r_2 < r_1$.

15. The method according to claim 10, wherein the step of adjusting the rotating speed of the refrigerating fan comprises decreasing the rotating speed of the refrigerating fan gradually with an increase of the temperature $T_H$.

* * * * *